United States Patent [19]

Meyer

[11] Patent Number: 5,074,015

[45] Date of Patent: Dec. 24, 1991

[54] UNIT FOR CONTINUOUS HEAT TREATMENT OF TEXTILE THREAD

[75] Inventor: Clement Meyer, Bernwiller, France

[73] Assignee: Passap Knitting Machines Inc., Salt Lake City, Utah

[21] Appl. No.: 557,954

[22] Filed: Jul. 25, 1990

[30] Foreign Application Priority Data

Jul. 26, 1989 [FR] France ..... 89 10276

[51] Int. Cl.[5] ..... D02G 1/20; B65G 21/00

[52] U.S. Cl. ..... 28/220; 198/631; 209/324; 19/65 T; 19/48; 28/281

[58] Field of Search ..... 19/46, 48, 65 T; 28/220, 281; 209/324, 350, 920; 198/631

[56] References Cited

U.S. PATENT DOCUMENTS

| | | | |
|---|---|---|---|
| 191,377 | 5/1877 | Shilling | 198/631 X |
| 1,187,143 | 6/1916 | Hanel | 198/631 |
| 2,244,203 | 6/1941 | Kern | 19/65 T |
| 2,743,004 | 4/1956 | Wright | 198/631 |
| 3,321,808 | 5/1967 | Kato | 19/65 T |
| 3,465,399 | 9/1969 | Sokolowski | 19/65 T |
| 3,953,161 | 4/1976 | Oguchi et al. | 19/46 X |
| 4,526,808 | 7/1985 | Strohmaier | 28/220 X |
| 4,754,619 | 7/1988 | Keith | 28/281 X |

FOREIGN PATENT DOCUMENTS

| | | | |
|---|---|---|---|
| 748434 | 5/1956 | United Kingdom | 19/48 |

*Primary Examiner*—Werner H. Schroeder
*Assistant Examiner*—John J. Calvert
*Attorney, Agent, or Firm*—Davis, Bujold & Streck

[57] ABSTRACT

The object of the present invention is the free retraction of thread spirals placed on a perforated conveyor belt during a heat treatment such as heat retraction or heat fixing of dyes. The device applies shaking movements or vibrations to a vertical component of the perforated belt, especially inside a heat treatment enclosure. It consists of an oscillating rotatable shaft transversely disposed inside the enclosure and applied to the lower surface of the belt. The shaft may have one or more plane surfaces, for example a rectangular transverse section.

8 Claims, 3 Drawing Sheets

UNIT FOR CONTINUOUS HEAT TREATMENT OF TEXTILE THREAD

The present invention relates to a continuous heat treatment unit for at least one textile thread, particularly with steam, wherein the thread is deposited as a continuous sheet of juxtaposed and superimposed spirals on a longitudinally movable perforated support, the perforated support is passed through at least one heat treatment enclosure and the thread is then separated without interruption for removal from the perforated support.

During this sort of heat treatment textile threads generally undergo retraction, one effect of which is to reduce the diameter of the spirals resting on the perforated support, which is usually a metallic mat serving as a conveyor belt. This phenomenon, as well as a steam installation for heat treatment, is described by way of example in French Patent Application No. 2.453.928. Retraction may be fairly significant with certain synthetic fibers and even more significant if it is necessary to "puff up" the thread to increase its volume. Furthermore, rubbing occurs inside the sheet of spirals as well as between the sheet and the support, which disturbs the spiral arrangement and tangles the spirals or prevents the desired retraction from being correctly produced. U.S. Pat. No. 2,733,498 describes a method of facilitating fabric retraction during washing wherein the wet fabric passes through an enclosure where it is freely suspended and beaten with movable arms during drying. These methods are not applicable to a continuous sheet of thread spirals.

This is why the objects of the present invention are to provide a device for use in such a heat treatment unit and which reduces rubbing between the threads or spirals and between the spirals and the perforated support, as rubbing counteracts thread retraction, and to substantially eliminate these effects.

To achieve this, the first feature of the invention concerns a device which applies shaking movements or vibrations to the continuous sheet of thread spirals placed on a continuously longitudinally movable perforated support, facilitating change in shape or size of the thread during heat treatment, said device comprising at least one oscillating mechanism disposed in a fixed location and shaking or vibrating the said perforated support during its continuous displacement.

In a preferred embodiment of the device, the oscillating mechanism comprises a movable support in cyclical contact with the lower surface of the perforated support. This movable support means may be a rotatable shaft transversely disposed in relation to the direction of the perforated support and having at least one plane surface beneath the lower surface of the perforated support. Said rotatable shaft may have one generally rectangular transverse section. Another embodiment of the oscillating mechanism may comprise a button for alternating oscillating motion activated by an electromagnet or cam device.

In an advantageous embodiment, the oscillating mechanism is disposed inside the heat treatment enclosure traversed by the perforated support. The same device may comprise drive means disposed outside the said enclosure for operating the said mechanism by means of a shaft traversing one wall of the enclosure. Said shaft may be rotatable and rigidly connected to a rotating rod on the oscillating device.

Another feature of the invention concerns a heat treatment unit having a device of the type described above, more specifically, a pressurized enclosure for pressurized steam treatment.

The present invention will be better understood with reference to the following description of one embodiment given by way of non-limiting example, and with reference to the attached drawings, wherein.

Figure 1:
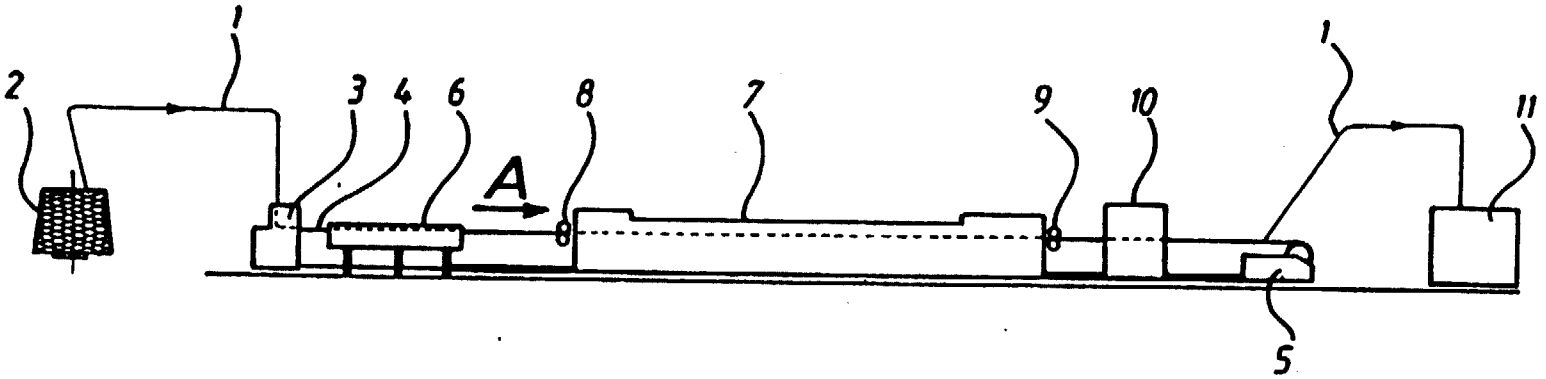
FIG. 1 is a lateral schematic view of a steam unit for continuous textile thread using the oscillating device according to the present invention.

FIG. 1 is a schematic representation of a heat treatment installation, wherein a series of textile threads 1 is continuously heat treated with steam. Threads 1 are unwound from bobbins 2 and, in the form of juxtaposed and superimposed spirals, are placed by depositing means 3 on a conveyor belt 4 which is usually a perforated metallic band, continuously driven from deposit point 3 toward return mechanism 5. In this example, the belt moves the thread spirals through chamber 6 for whatever preliminary treatment is to take place, a pressurized steam tunnel 7 with watertight seals 8 and 9, and a drying chamber 10 before they are removed from the belt by a rewinding device 11 capable of separating the threads to rewind them individually. This type of heat treatment installation is described only by way of example, as the device according to the invention is equally applicable to various installation designs.

Figure 2:
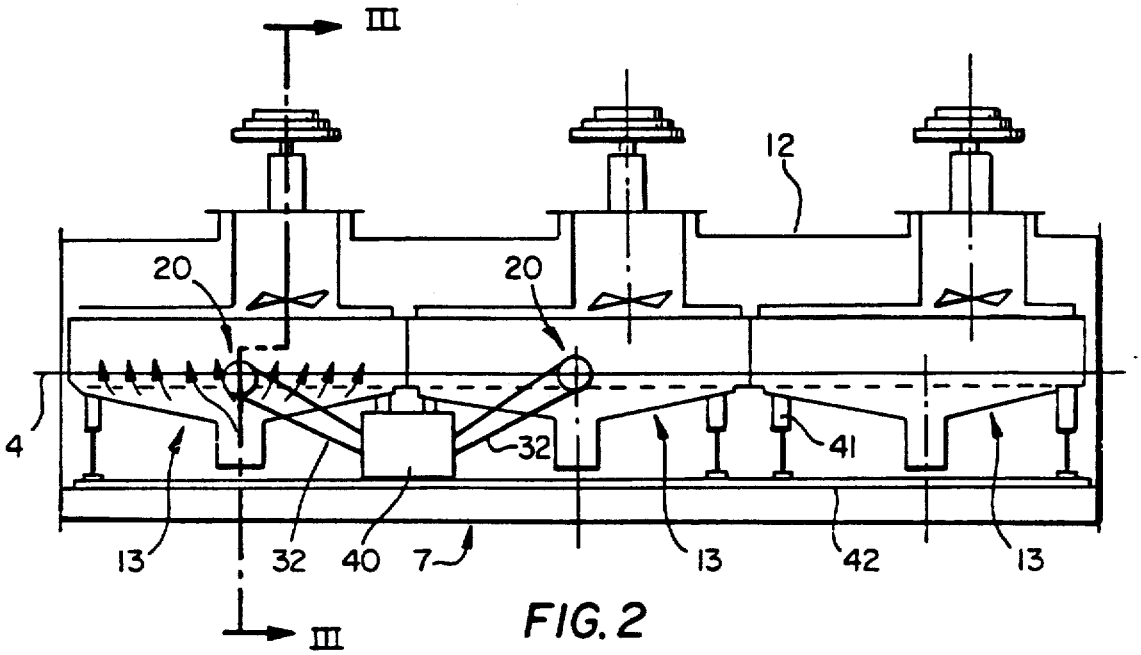
FIG. 2 is a schematic longitudinal cross section, of enlarged scale, of the portion of said unit equipped with the oscillation device.
Figure 3:
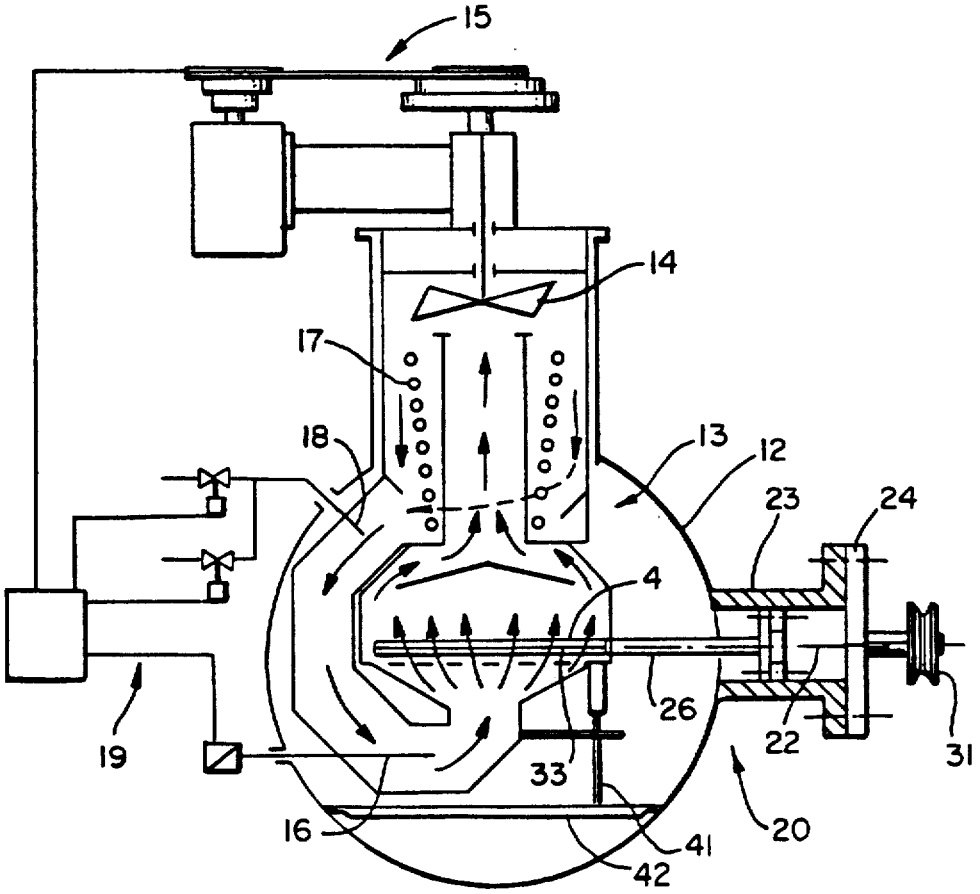
FIG. 3 is a schematic transverse cross section taken along line III—III of FIG. 2.

FIGS. 2 and 3 show the first portion of the steam tunnel 7, constructed in a modular fashion described in greater detail in French Patent Application No. 2,569,277, only the principal elements of which will be mentioned here. The steam tunnel comprises a pressurized enclosure 12 surrounding a series of consecutive compartments 13 with legs 41 resting on support 42 mounted on enclosure 12. Each compartment 13 is traversed by the perforated band 4 and ensures forced circulation of air or of an air-steam mixture through the band and the thread spirals it supports, in the direction indicated by the arrows in FIGS. 2 and 3. In this initial portion of tunnel 7 different temperature and humidity conditions are maintained in the various compartments 13, so that heat treatment may be progressively applied to the threads. This is why the circuit of air or air and steam in each compartment 13 includes not only a ventilator 14 driven by an exterior mechanism 15 of regulable speed, but also with a temperature probe 16, a heating device 17, and air and steam nozzles 18, as well as an exterior regulating means 19.

In compartments 13 the threads transported by belt 4 are progressively heated to a temperature of the order of from 110° to 130° C., depending on the nature of the thread, and because of this undergo retraction as indicated above. To ensure free retraction of the different thread spirals without detaining or creating tension in the threads and without the thread fibers catching in the belt perforations, vertical oscillations or vibrations are applied to belt 4 and to the threads thereon by means of one or more oscillating means 20 extending beneath the belt 4 inside at least one compartment 13, as shown in FIG. 3.

Figure 4:
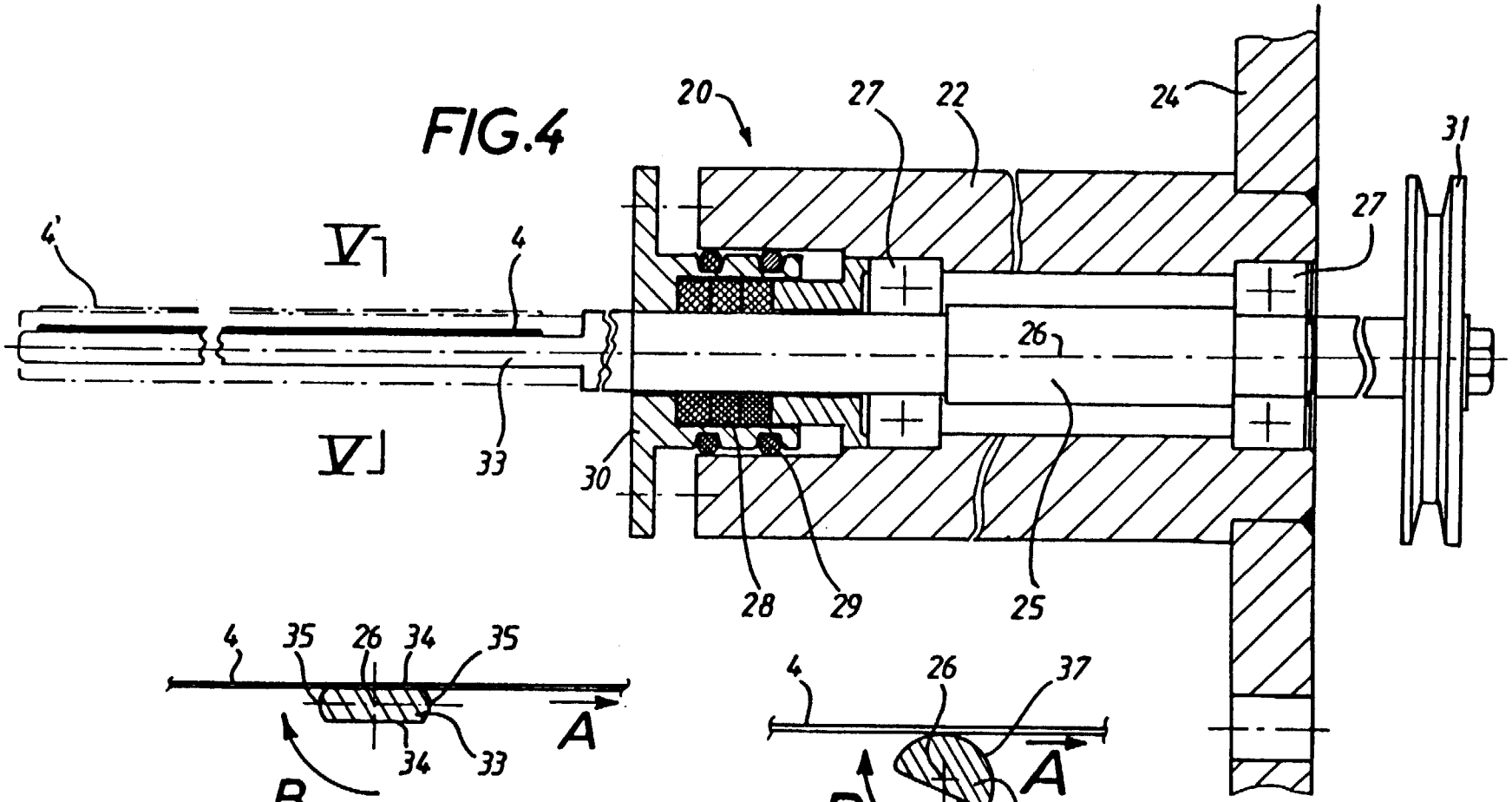
FIG. 4 shows an enlargement of one portion of the device shown in FIG. 3.
Figure 5:
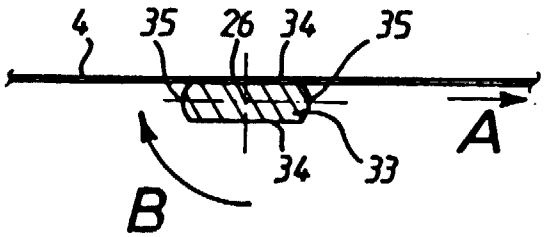
FIG. 5 is a cross section taken along line V—V of FIG. 4.

FIGS. 4 and 5 show an embodiment of the oscillating means 20 in greater detail, provided with a cylindrical case 22 mounted in a tube 23 encompassing a lateral opening of enclosure 12 (FIG. 3), as well as in a cover 24 of said opening. It comprises a horizontal shaft 25 rotatable around its axis 26 and mounted in casing 22 by means of platforms 27 and impermeable connectors 28 and 29 held in place by a metal plate 30. Outside the enclosure a pulley 31 is attached to the extremity of shaft 26 and connected by a belt 32 to a motorized drive mechanism 40 (FIG. 2) capable of activating several oscillating devices 20 at once.

The other extremity of axle 26 is an upright shaft 33 extending along the lower surface of the perforated belt 4, having an approximately rectangular transverse section, with two large flat surfaces 34 and two lateral surfaces 35 which may be convex. When the perforated belt 4 advances in the direction of arrow A, it contacts shaft 33 which turns in the direction of arrow B and raises it twice with each turn to position 4' represented by the broken line in FIG. 4. During each contact with the plane surface formed by a flat surface 34 of the shaft, belt 4 oscillates and transmits a certain length to the thread spirals by virtue of the strong tension on the belt.

Figure 6:
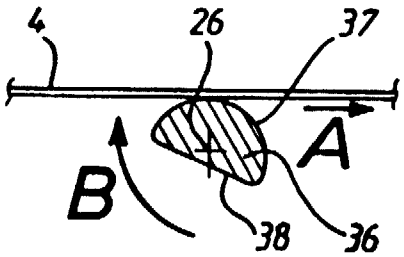
FIG. 6 is a cross section similar to FIG. 5, showing a variation of the embodiment.

In such a device, the amplitude and cadence of the oscillations may be freely selected by choosing a shaft 33 of appropriate dimension and making it turn at the desired speed. With the appropriate rotation speed, rubbing between the belt and the shaft can be considerably reduced, particularly if shaft 33 is replaced by shaft 36 such as shown in FIG. 6, with a cylindrical peripheral surface 37 interrupted by a flat portion 38.

In general, some tens of oscillations or movements per meter of belt length are sufficient to allow free retraction of the thread spirals. With usual belt speeds of the order of from 4 to 15 meters per minute, the number of oscillations or movements may range, for example, from 100 to 600 per minute, that is, shaft 33 must turn at a relatively low speed of from between 50 to 300 rotations per minute.

One advantage of the oscillation means 20 described above is that it occupies very little space inside the steam tunnel, with the drive means possibly being entirely on the outside. Only shafts 33 or 36 extend inside air and steam circulation compartments 13, so that their construction need not be modified.

The present invention is not limited to the example of the embodiment described herein, but extends to all modifications and variations obvious to one skilled in the art. In particular, it would be possible to combine the oscillation means with the means supporting the perforated belt 4. Instead of rotatable organs beneath the belt, vertically movable alternating devices could be used, for example, by rotating cams or alternating elements controlled by electromagnets.

I claim:

1. A heat treatment unit for continuously treating at least one textile thread, particularly with steam, said unit comprising:

a treatment enclosure having a thermally controlled atmosphere, conveyor means provided with an endless perforated support continuously driven along a longitudinal path traversing said treatment enclosure, said perforated support supporting a continuous length of thread spirals, means for continuously depositing at least one thread upon said perforated support upstream of said treatment enclosure, means for continuously removing the at least one thread from said perforated support downstream of said treatment enclosure, at least one oscillation means cooperating with the perforated support for applying a shaking movement or vibration to said perforated support as it is driven along its longitudinal path, said at least one oscillation means being disposed inside said treatment enclosure and being situated at a fixed location along the path of the perforated support, and drive means disposed outside said treatment enclosure and connected to said at least one oscillation means by means of a rotatable connection traversing a wall of said enclosure.

2. A heat treatment unit according to claim 1, wherein the said treatment enclosure is a pressurized enclosure.

3. A heat treatment unit according to claim 1, wherein the at least one oscillation means comprises a rotatable support means in cyclical contact with the lower surface of the perforated support.

4. A heat treatment unit according to claim 3, wherein the rotatable support means is a rotatable shaft transversely disposed in relation to the direction of movement of the perforated support and having at least one plane surface beneath the lower surface of the perforated support.

5. A heat treatment unit according to claim 4, wherein the rotatable shaft has a generally rectangular transverse section.

6. A heat treatment unit according to claim 1, wherein said rotatable connection is rigidly attached to said rotatable shaft.

7. A device for applying a shaking motion or vibration to a continuous length of thread spirals placed on a continuously longitudinally perforated support movable through a heat treatment enclosure, to facilitate changes in thread shape and dimension, said device comprising at least one oscillation means, disposed in a fixed location in the heat treatment enclosure, for applying a shaking movement or vibration to said perforated support during the continuous movement of said perforated support;

the at least one oscillation means being traversed by the perforated support; and drive means, situated outside said treatment enclosure, controlling the at least one oscillation means via a shaft member traversing a wall of said enclosure.

8. A heat treatment unit for continuously treating at least one textile thread with steam, said unit comprising:

a treatment enclosure having a thermally controlled atmosphere, conveyor means provided with a perforated support driven along a longitudinal path traversing said treatment enclosure, said perforated support supporting a continuous length of thread spirals, means for continuously depositing at least one thread upon said perforated support upstream of said treatment enclosure, means for continuously removing the at least one thread from said perforated support downstream of said treatment enclosure, at least one oscillation means cooperating with the perforated support for applying a shaking movement or vibration to said perforated support as it is driven along its longitudinal path, said at least one oscillation means being disposed inside said treatment enclosure and being situated at a fixed location along the path of the perforated support, and drive means disposed outside said treatment enclosure and connected to said at least one oscillation means by means of a rotatable connection extending through a wall of said enclosure.

* * * * *